US007399142B2

(12) United States Patent
Foo et al.

(10) Patent No.: US 7,399,142 B2
(45) Date of Patent: Jul. 15, 2008

(54) INTERACTIVE LEG GUIDE FOR OFFSHORE SELF-ELEVATING UNIT

(75) Inventors: Kok Seng Foo, Singapore (SG); Chin Kau Matthew Quah, Singapore (SG); Cheng Choong Chan, Singapore (SG)

(73) Assignee: Offshore Technology Development Pte Ltd., Singapore (SG)

( * ) Notice: Subject to any disclaimer, the term of this patent is extended or adjusted under 35 U.S.C. 154(b) by 203 days.

(21) Appl. No.: 11/228,962

(22) Filed: Sep. 15, 2005

(65) Prior Publication Data

US 2006/0056920 A1 Mar. 16, 2006

(30) Foreign Application Priority Data

Sep. 15, 2004 (SG) ..... 200405080-3

(51) Int. Cl.
*E02B 17/08* (2006.01)

(52) U.S. Cl. ..... 405/198; 405/211

(58) Field of Classification Search ..... 405/196–198, 405/211, 212, 216
See application file for complete search history.

(56) References Cited

U.S. PATENT DOCUMENTS

| | | | | | |
|---|---|---|---|---|---|
| 3,183,676 | A * | 5/1965 | Le Tourneau | ..... | 405/196 |
| 3,343,371 | A * | 9/1967 | Heitkamp | ..... | 405/198 |
| 4,015,434 | A * | 4/1977 | Tarrant | ..... | 405/198 |
| 4,422,802 | A * | 12/1983 | Choate | ..... | 405/198 |
| 4,480,491 | A * | 11/1984 | Durand et al. | ..... | 74/411 |
| 4,574,650 | A * | 3/1986 | Durand et al. | ..... | 74/411.5 |
| 4,627,768 | A * | 12/1986 | Thomas et al. | ..... | 405/198 |
| 2005/0063787 | A1 * | 3/2005 | Ingle | ..... | 405/198 |

* cited by examiner

*Primary Examiner*—Tara L. Mayo
(74) *Attorney, Agent, or Firm*—Thelen Reid Brown Raysman & Steiner

(57) ABSTRACT

A leg guide for use in a leg of a jack up unit adapted to provide sliding guidance of the leg during vertical movement of the leg. The leg guide has a first portion contacting an edge of a leg chord and a second portion contacting a face of the leg chord along a longitudinal plane opposite the contact plane of the first portion. The edge contacting guide has a deflecting guide unit, which uses a compressible member sandwiched between two rigid plates. As the leg moves, the teeth of the leg chord contact the edge guide unit, with the compressible member absorbing compressible loads acting on the leg chord. The second portion provides for a face plate mounted transversely to the edge contacting guide for reducing the build-up of horizontal moment acting on the leg chord during the vertical movement of the leg and for reducing bending moments acting on the leg.

3 Claims, 6 Drawing Sheets

INTERACTIVE LEG GUIDE FOR OFFSHORE SELF-ELEVATING UNIT

BACKGROUND OF THE INVENTION

This invention relates to offshore structures, and more particularly to offshore structures adapted for supporting oil and gas exploration/production operations at sea. Even more particularly, the invention relates to a type of an offshore structure known as a jack-up unit. A typical jack-up unit design uses a floatable hull with three or four supporting legs, which may be circular, square or triangular in cross-section, extending through the hull within leg guides. The legs may be built as truss units using a system of horizontal and diagonal braces. The legs support the hull during offshore operations, and are supported by the hull during transit.

Once the platform is delivered to the desired location, the legs are lowered through openings in the hull to reach the seabed. The legs are secured to the bottom and then the hull is elevated to the operational height. The lowering and raising of the legs is performed by a plurality of jack-up assemblies typically located at the corners of the platform.

In a typical rack and pinion type jacking system, there are a total of nine jacking assemblies, three assemblies per leg of legs having triangular configuration. Each jacking assembly unit comprises four to six pinions, which are housed in a jack frame and supported on bearings. A series of guide plates are installed above and below the jacking mechanism. The guide system consists of upper guide plates, middle guide plates and lower guide plates. Gaps between the guide plates and rack are pre-determined to ensure smooth transition in raising and lowering of the legs.

Conventional assembly of guide plates is shown in FIG. 2. The guide is firmly fixed to the supporting structure. Edge guide plates 1 are located in opposite edges of the rack teeth 2. The edge guide plates 1 allow the rack teeth 2 to support and slide during the jacking process. Initially, when the whole hull unit is resting on the pinions, the differential loads on the pinions cause a vertical moment couple during the jacking up process.

Under environmental loads, the unit tilts and the rack teeth will react against the guide plates 1. This generates a reaction on the guide plates along the chord and indirectly on the horizontal and the diagonal braces 3. The differential loads on the guide plates cause a horizontal moment couple to be developed. As the jacking process continues, the transfer of the loads from a vertical to a horizontal moment couple increases. As a result, the legs between the upper and lower guide plates sustain a large bending moment. Thus the horizontal and diagonal braces between the upper and lower guide plates develop compressive and tensile forces. Since the legs have truss structure, the braces tend to fail under compressive load that is built up due to the horizontal moment couple.

The industry understands that high compressive loads are undesirable as they result in buckling of the braces under severe environmental conditions. For example, when a rig suffers a severe punch through situation or when the spud can at the base of the unit slides into old footings. This guide assembly is inefficient, as the generated high compressive loads located mainly between the upper and lower edge plates. This constitutes a local failure within the system. A premature load buckling of the brace eventually occurs. In the conventional system, since only a few top and bottom plates are reacted, the development of the horizontal moment couple is high. Only a small number of guide plates 1 are sharing the reacted loads.

The capacity of the drilling unit to maintain stability and strength during working conditions is determined by the extent the braces are subjected to the loads through the guide plates 1. Under harsh environmental conditions, the leg structure would deflect and a large bending moment is generated; the large bending moment is reacted against by the guide plates along the rack teeth 2. This reaction generates high compressive loads in the bracing members, which results in failure of the brace by buckling. To overcome this phenomenon, a system of guide plates is installed to significantly reduce the buckling loads exerted on the braces by converting an otherwise compressive load into tensile load.

The present invention contemplates elimination of drawbacks associated with the prior art and provision of an improved system of guide plates in a jacking system.

SUMMARY OF THE INVENTION

It is, therefore, an object of the present invention to provide a guide assembly for leg structures in a jack-up unit.

It is another object of the present invention to provide a leg guide assembly that would allow distribution of the loads vertically and limiting horizontal moment acting on the leg structure.

It is a further object of the present invention to provide a leg guide assembly that would eliminate undesirable concentration of loads within the upper and lower leg guide assemblies.

These and other objects of the present invention are achieved through a provision of a guide system for each of the support legs of the jack-up platform. The guide system has a first portion for providing a reactive surface for an edge of the rack of the leg chord and a second portion oriented transversely to the first portion and providing a reactive surface for the face of the leg chord when there is a large force acting on the structure.

The first portion has a deflectable guide unit comprised of an edge guide plate, an attachment plate, and a compressible resilient member sandwiched between the two plates. The second portion has a face guide plate, which extends longitudinally along the leg chord at strategic locations to reduce the horizontal bending loads acting on the legs.

Introduction of the compressible member behind the edge guide plate allows to decrease stiffness of the contact surface, while maintaining hardness and strength of the contact surface of the edge guide plates. As the edge guide plate deflects, the increased bending profile allows more edge guide plates to be in contact with the rack at the same time. Provision of the compressible member allows for better load distribution along the longitudinal plane of the leg guide system.

DETAILED DESCRIPTION OF THE PREFERRED EMBODIMENT

Reference will now be made to the following detailed description, taken in conjunction with the accompanying drawings, wherein like parts are designated by like numerals.

Figure 1:
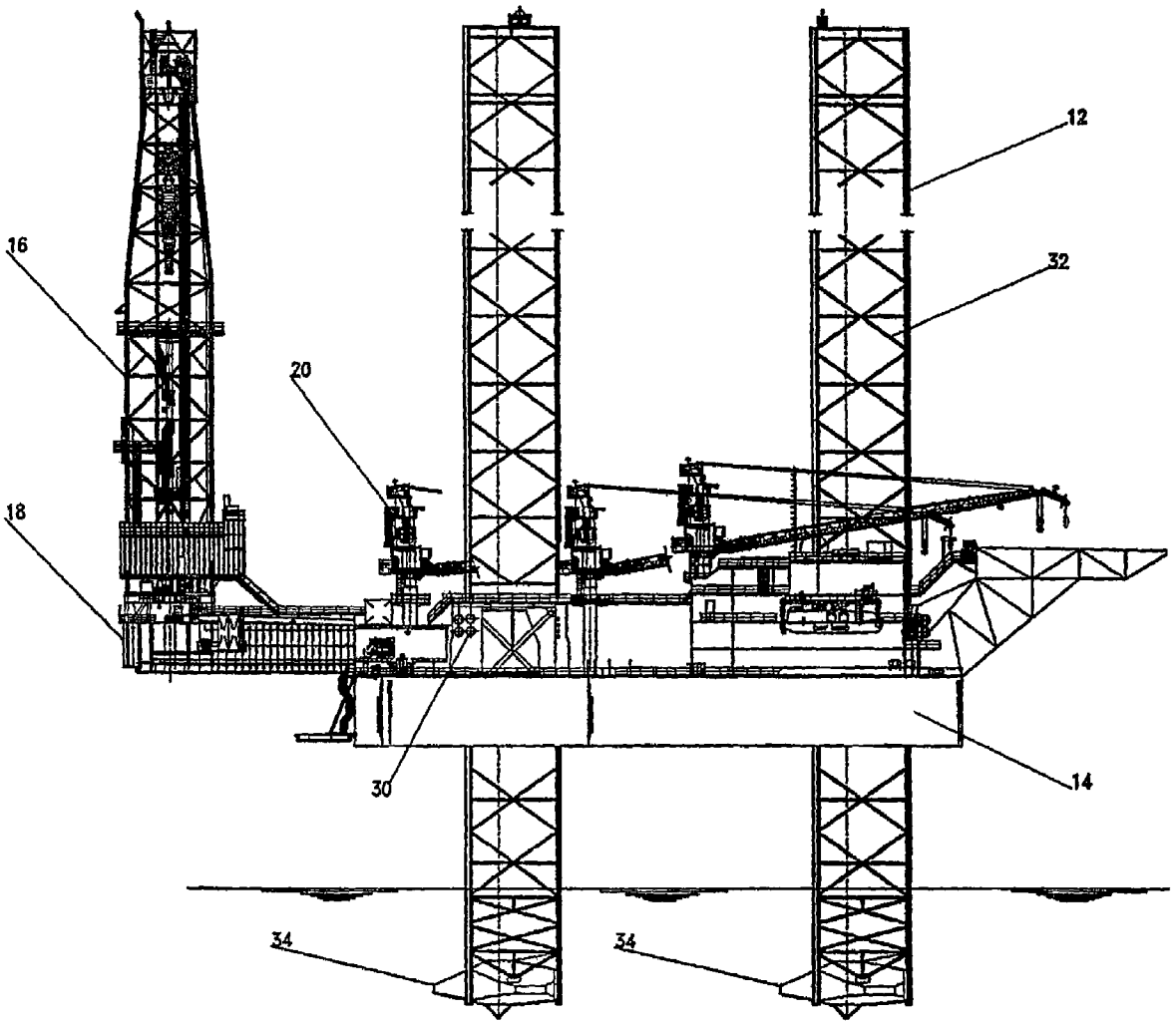
FIG. 1 is an outboard profile of a jack-up unit of the present invention with truss legs.

Referring now to FIG. 1, it shows a self-elevating jack-up unit. The jack-up unit is a mobile offshore structure that is used for mineral exploration and production. A typical jack-up unit is provided with a plurality of truss legs 12, which extend through openings in a floatable hull 14 of the jack-up unit. Although any number of legs may be used to support the hull 16, for illustration purposes, the jack-up rig shown in FIG. 1 has three such legs 12. The legs 12 are formed a system of horizontal and diagonal braces.

As the legs 12 are "jacked," the hull 14 is elevated above an anticipated wave action to support the offshore exploration and/or production operations. Conventional offshore structures, such as the jack-up unit, are equipped with a derrick 16 mounted on the hull 14. The derrick 16 may be also mounted on a cantilever structure 18, which extends outwardly from the hull 14, as shown in FIG. 1.

The derrick 16 may be positioned for a limited lateral movement to accommodate well drilling in a plurality of locations without changing the position of the legs 12. The jack-up unit may be also provided with auxiliary equipment, such as cranes 20, pipe racks, heliport, crew living quarters, etc.

Figure 3:
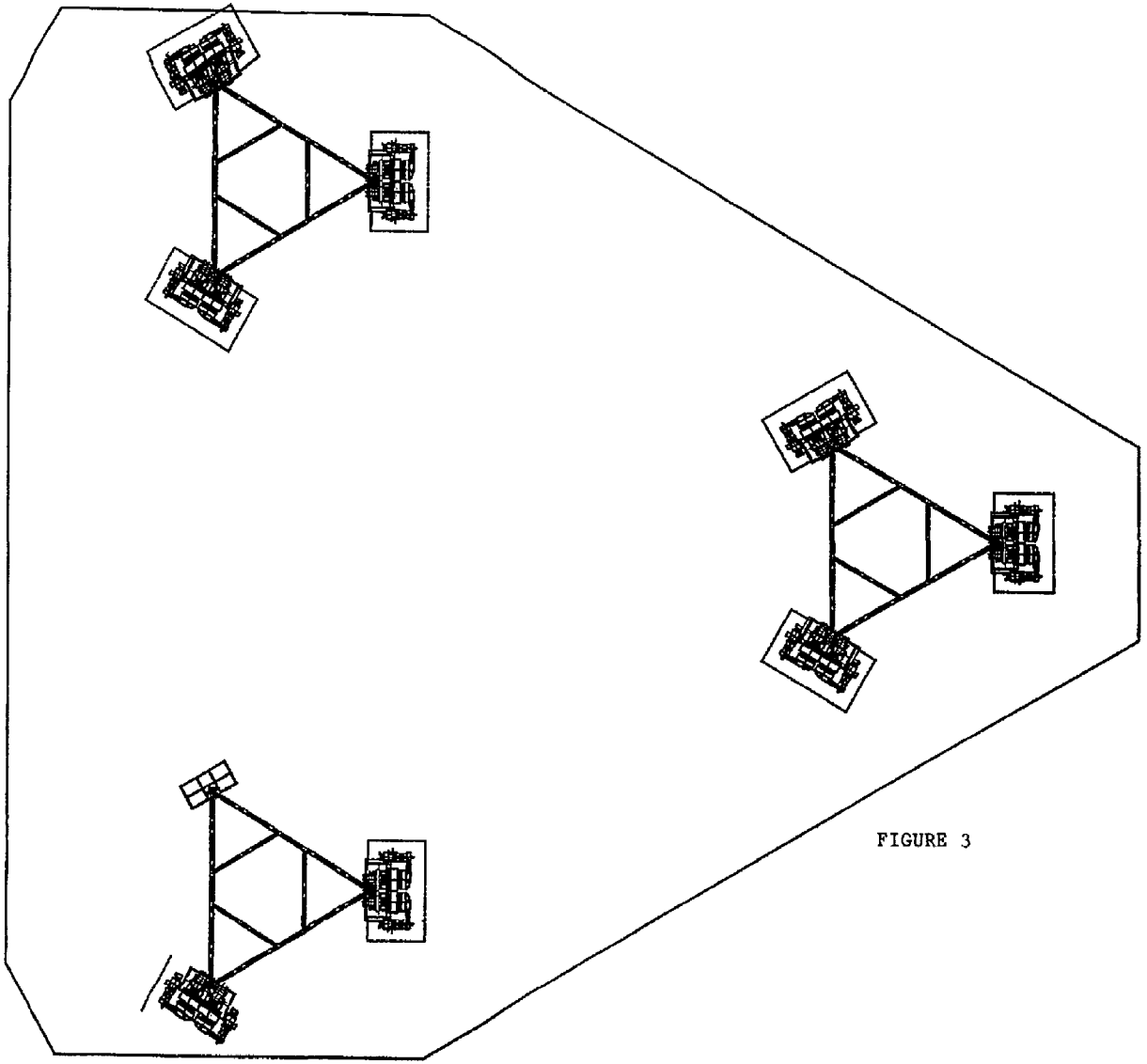
FIG. 3 is a schematic view illustrating the general arrangement of a jacking system in relation to the platform legs.

A typical leg of a jack-up unit has three chord members 22 and each chord member is provided with a pair of opposing rack members 24 that extend longitudinally along the length of the chords 22. The outward surfaces of the racks are provided with rack teeth 26 (FIG. 6), which engage respective teeth of rack chocks carried by jacking assemblies 30 (FIG. 3).

Conventionally, there is one jack assembly for each chord member 22. Horizontal and inclined braces or trusses 32 rigidly interconnect the chords 22. The chords 22 are located at apexes of the triangularly shaped legs 12. Of course, the number of chords and the shape of the legs are not limited to the embodiment shown in the drawings.

Each leg 12 is provided with the jacking assemblies 30 for moving the leg vertically with respect to the hull 14. The legs 12 move from a raised position, when the jack-up unit is in transit and the legs 12 are supported by the hull 14, to a lowered position, when the legs 12 support the hull 14. The lowered position is illustrated in FIG. 1. Each leg 12 may be provided with a spud can 34 for bearing against an ocean floor and for supporting the jack-up unit.

Figure 2:
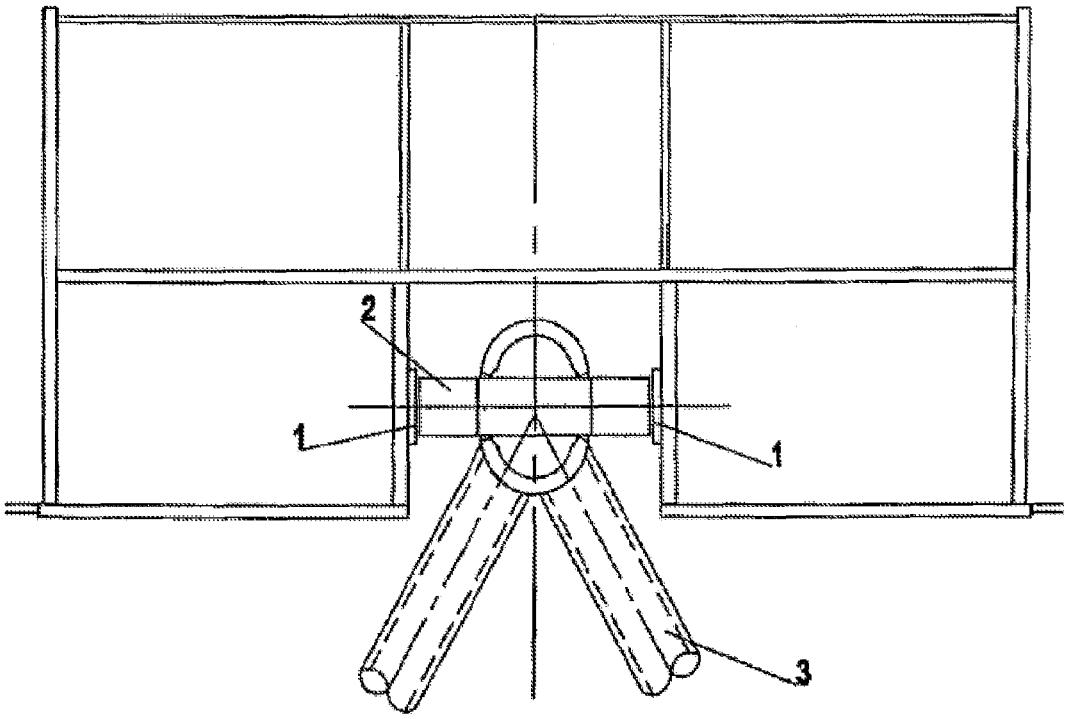
FIG. 2 is a detail view of a conventional design of edge guide plates and rack teeth of a typical jack-up unit.

The jack assemblies 30 are retained against vertical displacement by the hull 14. As shown in FIG. 2, a typical jack-up unit has nine jacking assemblies 30; three assemblies per leg, with one located at each leg chord 22 of the triangularly shaped legs 12. Each elevating jack assembly 30 is provided with four pinions, which operationally engage teeth 26 of racks 24 associated with the legs 12. The jacking system also includes a system of guide plates installed above and below the pinions. The guide plates act as a horizontal restraint for the drilling unit as they deflect under harsh environmental conditions.

Figure 4:
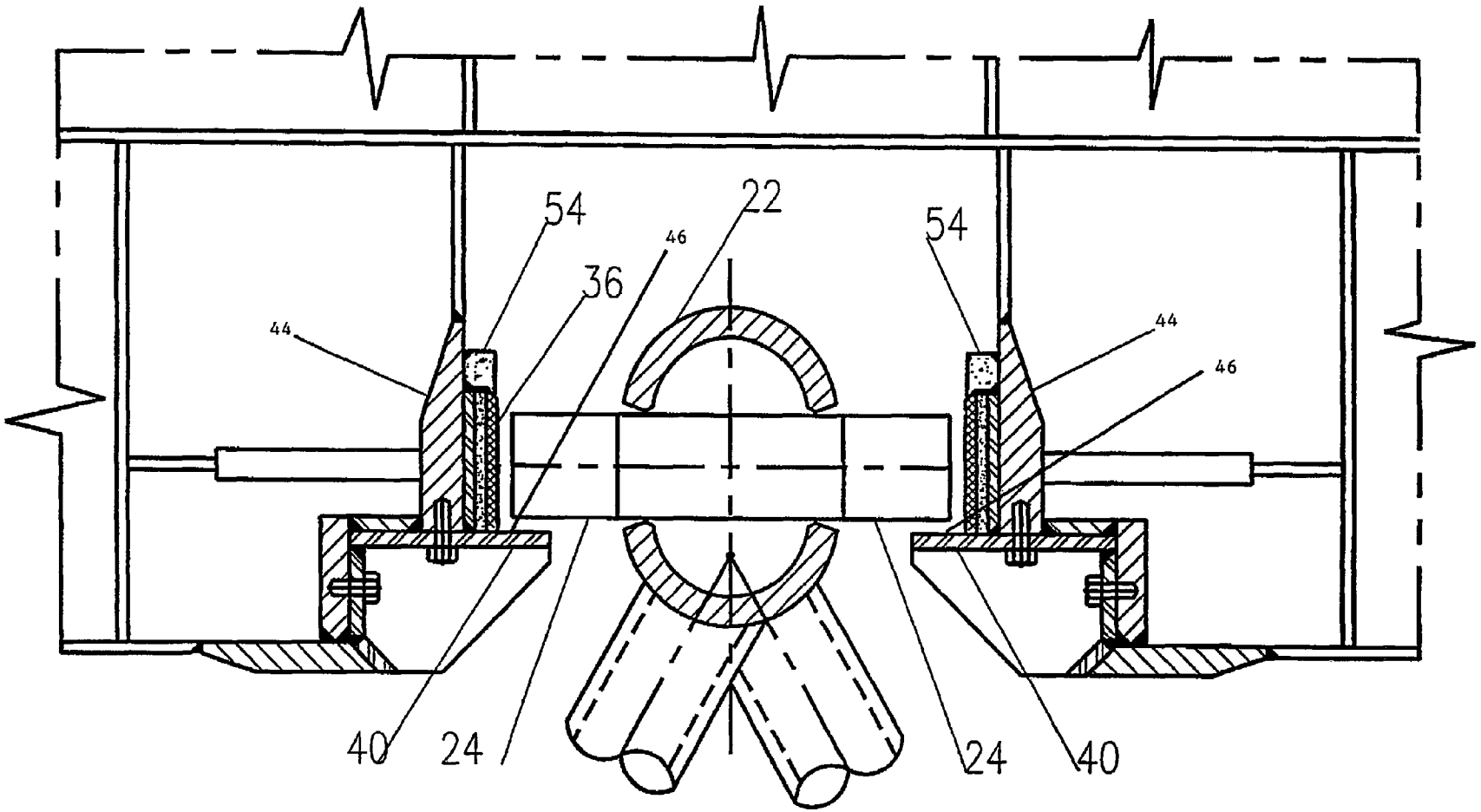
FIG. 4 is a schematic view illustrating the leg guide system of the present invention.
Figure 5:
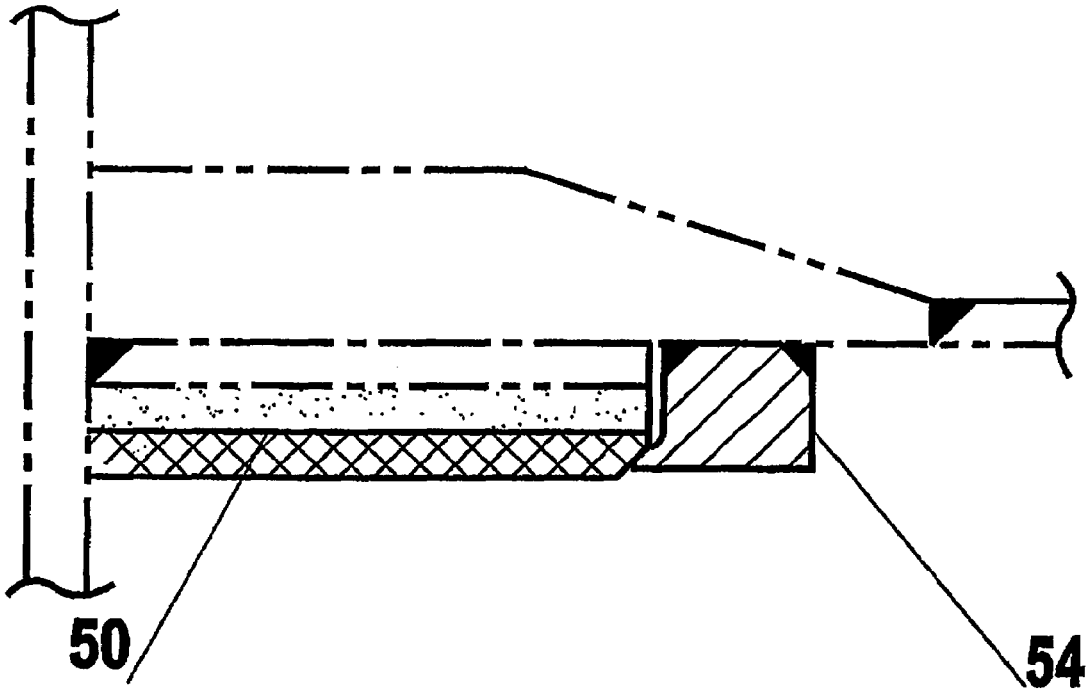
FIG. 5 is an end view of the guide system of the present invention showing a compressible member.
Figure 6:
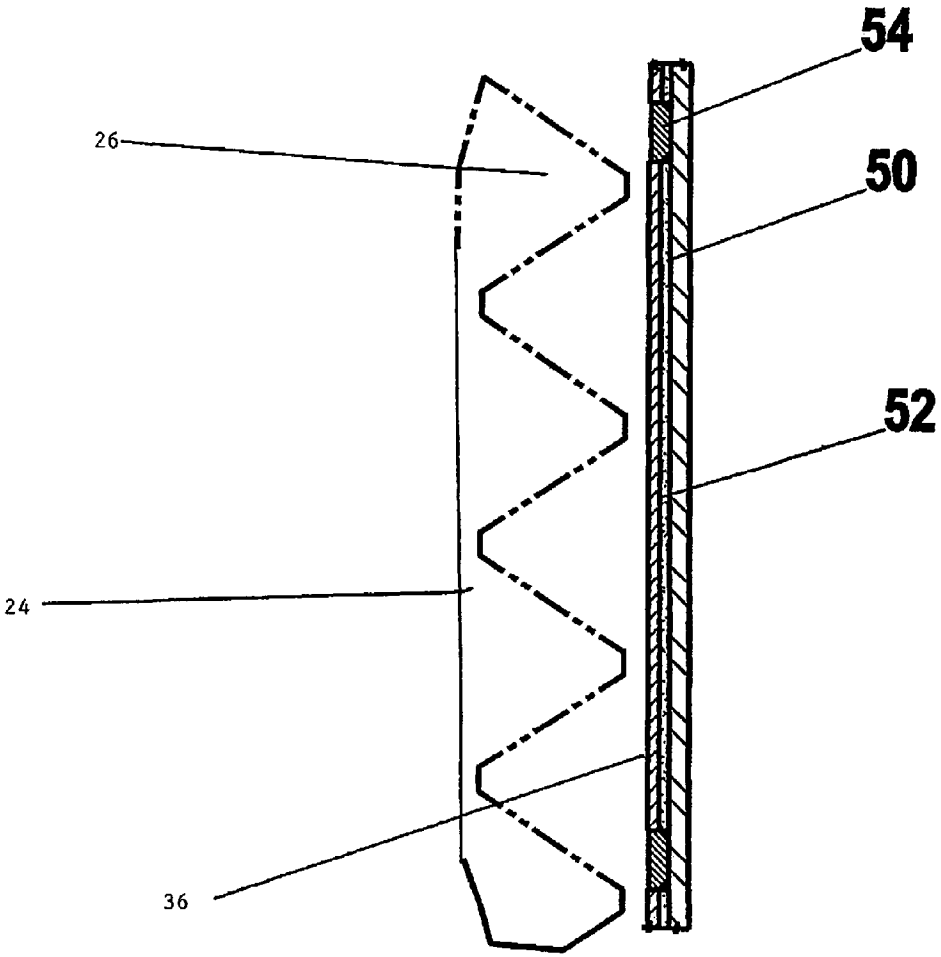
FIG. 6 is a schematic side view of the guide system of the present invention.

Turning now in more detail to FIG. 4-6, the leg guide system of the present invention is shown to comprise a plurality of edge guides 36 positioned along the opposite edges of the rack 24. A plurality of face guides, or face guide plates 40 is secured in a transverse relationship to the edge guides 36, extending in a generally parallel relationship to a face 42 of the rack 24. The face guides 40 extend, to a distance toward a center of the rack 24. In a typical design, there may be two to four face guides 40, although a larger number may be employed depending on the complexity and the load transfer requirements. The face guide plates 40 are installed in strategic locations (FIG. 4) at the level of lower wear plates along the vertical extension of the guide system.

Each face guide plates 40 is detachably secured to an attachment member 44 by bolts or other similar method. In this position, an inner surface 46 of each face guide plate 40 contacts a side of the edge guide plate 36. A compressible member 50 is fitted behind each edge guide plate 36. The compressible member 50 is formed from a compressible, resilient, elastic material capable of withstanding compressive loads acted on the edge guide plate 36.

The compressible member 50 allows for changes in stiffness of the edge guide plates 36 to absorb the compressive loads on the edge guides, or edge guide plates 36. In conventional systems, high compressive loads are built up on the edge guide. Since the stiffness of the edge guide is high, reacted loads increase, and only a few edge guide plates are fully utilized. Such arrangement has an undesirable effect on the braces within the guide assembly.

Introduction of a compressible member 50 behind the edge guide plate 36 allows for a lower stiffness and at the same time allows maintaining hardness and strength of the contact surface of the edge guide plates and increases their wear. The decreased stiffness of the edge guide plate 36 allows for small deformation to take place in the assembly of the instant invention. As the edge guide plate deforms, the increased bending profile allows more edge guide plates 36 to be in contact with the rack at the same time. However, the increased bending profile does not contribute towards the horizontal moment couple since the bending of the leg is due to the deformation of the edge guide plate 36.

Loads are distributed along the guide plates vertically. Those attracting lower loads will deform the compressible member 50 less and those of higher loads will compress the member 50 more, resulting in a more uniformly load distribution system. Additionally, the leg structure is allowed to bend in the most efficient manner that imposes the least load.

As the compressible member 50 is compressed, the gap distance between the teeth 26 and the edge guide plates 36 increases. However, since the member 50 undergoes only elastic deformation, the initial gap distance will be maintained when the load is reduced or removed. The elasticity of the compressible member 50, therefore, allows more uniform sharing of the loads among the guide plates when the load is high and still maintain the initial gap distances when the load is reduced.

The face guide plates 40 are installed adjacent to the edge guide assemblies. When the leg 12 deflects, top and lower guides are reacted against the rack teeth 26. This reaction generates a horizontal moment couple within the guide assembly. When the leg 12 bends, the section of the leg closer to the lower guide tends to deflect more. In the conventional guide system, without a face guide, the rack teeth 26 will move laterally, generating high bending moment within the upper and lower guides. When the face guide plates 40 are installed, the rack teeth 26 react against the face guides 40 and prevent further bending of the leg 12. As a result, the amount of build up of the horizontal bending moment is reduced. At the same time, provision of the face guide plates 40 changes the loading mechanism of some braces from a compressive to a tensile force, reducing the brace force, while increasing the overall capacity of the jack-up unit.

Some of the braces within the upper and lower guide plates have a reversed loading effect. Provision of the additional face guides 40 eliminates the undesirable concentration of compressive loads within the upper and lower guide assembly. As the leg structure is arranged in a triangular truss system, the diagonal braces 32 are beneficially oriented at 60 degrees from each other. The face guide plates 40 are affixed at 90 degrees in relation to the edge guide plates 36 and hence will allow the bracing to extend rather than compress. Since bracing members can absorb more tension than compression, the face guide plates 40 reduce excessive compressive loads from developing, resulting in a more efficient leg structure.

An attachment plate 52 is mounted on the opposite side of the compressible member 50, "sandwiching" the compressible member 50 between two rigid plates. A stopper 54 engages an end of the edge guide plate 36 opposite the end where the face guide plate 40 contact the edge guide plate 36. The stopper 54 also engages corresponding ends of the compressible member 50 and the attachment plate 52. The stopper prevents free movement of the edge guide plate 36, the attachment plate 52 and the compressible member 50. The attachment plate 52 contacts the attachment member 44 (FIG. 4) thereby retaining the edge guide assembly comprises of the edge guide plate 36, the compressible member 50, and the attachment plate 52, in place.

The guide plates guide the leg chords during the vertical movement. In the design of the present invention, the number of guide plates is increased, thereby allowing transfer of the reacted loads to a greater number of plates and lower the reacted loads on the plates so as to create a smaller horizontal moment couple than is possible with conventional systems. As a result, the loads are distributed along the guide plates vertically.

The introduction of the face guides 40 and the compressible members 50 greatly improves the overall efficiency of the jack-up unit especially the loading mechanism within the upper and lower guides. By reducing the buckling load on the braces helps to prevent local failure of the braces during incidents like punch through and sliding of the legs.

An additional advantage of the design of the present invention is that it allows retaining much of the currently available guide assembly system. Only minor changes need to be made to retrofit the existing system with face guide plates and the compressible members. No major alterations in the overall rig design are required. The cost of installation of the compressible members 50 and the face guides 40 is minimal compared to the overall cost of the rig. However, the benefits of greater efficiency and load sharing between the braces well outweigh any potential expenditures in retrofitting existing structures. The current capacity of the legs 12 can be made more robust by an effective use of the face guide plates installed at strategic locations to allow a more even distribution of compressible loads acting on the legs.

Many changes and modifications may be made may be made in the design of the present invention without departing from the spirit thereof. We, therefore, pray that our rights to the present invention be limited only by the scope of the appended claims.

We claim:

1. A guide assembly for a leg of a jack-up unit, the leg having a plurality of leg chords each carrying rack teeth along a vertical face thereof, the guide assembly comprising:

an edge guide means for contacting a vertical edge of the rack teeth, said edge guide means comprising a means for absorbing compressible loads acting on the rack teeth, a longitudinally elongate edge guide plate extending in a generally parallel relationship to a respective leg chord, said edge guide plate comprising a contact surface, and said means for absorbing compressible loads comprising a compressible resilient member secured to a non-contact surface of the edge guide plate, and wherein the rack teeth react against the contact surface during vertical movement of the legs, said edge guide means further comprising an attachment plate engaging said compressible resilient member along a length thereof opposite said edge guide plate;

a face guide means secured transversely to the edge guide means for reducing the build-up of horizontal moment acting on the leg and comprising a face guide plate engaging a first vertical edge of each of said edge guide plate, said compressible member and said attachment plate; and a means for limiting lateral movement of said edge guide plate, said compressible member and said attachment member, wherein said means for limiting lateral movement comprises a stop member engaging a second vertical edge of said edge guide plate, said compressible member and said attachment member.

2. In an offshore jack-up unit having a hull, a plurality of support legs extendable from the hull downwardly for selective bearing engagement with a seabed for supporting the hull above the water surface and means to selectively effect relative vertical movement between the hull and the legs, each support leg having at least one leg chord with rack teeth, a variable leg guide assembly comprising:

an edge guide means for providing longitudinal sliding guidance of the leg chord during the vertical movement of the leg, said edge guide means comprising a means for absorbing compressible loads acting on the leg chord, longitudinally extending an edge guide plate for providing a reactive contact for the leg chord rack teeth, a compressible member mounted along a non-contact surface of the edge guide plate and an attachment member securing said compressible member to the edge guide plate;

a face guide means secured transversely to the edge guide means for reducing the build-up of horizontal moment acting on the leg chord during the vertical movement of the leg, face guide means comprising a face guide plate oriented at a 90 degree angle to a vertical axis of the edge guide plate, said face guide plate contacting a first end of said edge guide plate, said compressible member and said attachment member; and a means for limiting lateral movement of said edge guide plate, said compressible member and said attachment member, wherein said means for limiting lateral movement comprises a stop member engaging a second vertical edge of said edge guide plate, said compressible member and said attachment member.

3. For use in a leg of a jack up unit, a leg guide assembly adapted to provide sliding guidance of the leg during vertical movement of the leg, the leg guide assembly comprising: a deflectable edge guide assembly adapted to provide a reactive surface for at least one leg chord of the leg and for absorbing compressible loads acting on the leg chord, said deflectable edge guide assembly comprising an edge guide plate for providing a longitudinal bearing surface for an edge of the leg chord, a compressible member mounted along a non-contact surface of the edge guide plate and an attachment member securing said compressible member to the edge guide plate; and a face guide means secured transversely to the edge guide assembly for reducing the build-up of horizontal moment acting on the leg chord and bending moment acting on the leg, said face guide means comprising a face guide plate oriented at a right angle to a vertical axis of the edge guide plate, said compressible member and said attachment member, said face guide plate contacting a first end of said edge guide plate, said compressible member and said attachment member, and a stop member for limiting lateral movement of said edge guide plate, said compressible member and said attachment member, said stop member being mounted along a second end of the edge guide plate, the compressible member and the attachment member.

* * * * *